US009981313B1

(12) United States Patent
Cappillino et al.

(10) Patent No.: US 9,981,313 B1
(45) Date of Patent: May 29, 2018

(54) POROUS METALS FROM SINTERING OF NANOPARTICLES

(71) Applicant: Sandia Corporation, Albuquerque, NM (US)

(72) Inventors: Patrick J. Cappillino, Fremont, CA (US); David B. Robinson, Hayward, CA (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 818 days.

(21) Appl. No.: 13/917,762

(22) Filed: Jun. 14, 2013

Related U.S. Application Data

(60) Provisional application No. 61/673,385, filed on Jul. 19, 2012.

(51) Int. Cl.
*B22F 5/10* (2006.01)
*B22F 1/02* (2006.01)

(52) U.S. Cl.
CPC . *B22F 5/10* (2013.01); *B22F 1/02* (2013.01)

(58) Field of Classification Search
CPC . H01L 23/28; H01L 21/56; C08K 3/08; B01J 23/00; B01J 21/00; B01J 20/00
USPC ..... 257/793; 502/7, 240; 524/439
See application file for complete search history.

(56) References Cited

U.S. PATENT DOCUMENTS

| | | | | |
|---|---|---|---|---|
| 8,431,506 | B2 * | 4/2013 | Neltner et al. | 502/7 |
| 2002/0037994 | A1 * | 3/2002 | Yang | 528/422 |
| 2006/0211802 | A1 * | 9/2006 | Asgari | 524/439 |
| 2011/0241229 | A1 * | 10/2011 | Naasani et al. | 257/793 |

OTHER PUBLICATIONS

Cappillino, P.J., et al., "Nanoporous Pd alloys with compositionally tunable hydrogen storage properties prepared by nanoparticle consolidation," J. Mater.Chem., Jun. 11, 2012, 22, 14013-14022.*
Cappillino, P.J., et al., "Nanoporous Pd alloys with compositionally tunable hydrogen storage properties prepared by nanoparticle consolidation," J. Mater. Chem., 2012, 22, 14013-14022.
Dendritech, "PAMAM Dendrimers," http://dendritech.com/pamam.html (Aug. 20, 2012).

* cited by examiner

*Primary Examiner* — Matthew E Hoban
*Assistant Examiner* — Christopher Kessler
(74) *Attorney, Agent, or Firm* — Womble Bond Dickinson LLP

(57) ABSTRACT

A method including encapsulating or capping metallic nanoparticles by a dendrimer or a polymer with binding sites for metal particless or metal ions dispersed in a fluid; modifying the fluid to disrupt the interaction of the dendrimer or polymer with the particles; and subsequently or concomitantly sintering or partially consolidating the zero valent metal. A method including introducing a first metal salt and a second metal salt into a dendrimer or a polymer with binding sites for metals or metal ions; reducing a metal ion of the first metal salt to a zero valent first metal and a metal ion of the second metal salt to a zero valend second metal; disrupting an interaction between the dendrimer or the polymer and the first metal and the second metal; and sintering or partially consolidating the first metal and the second metal.

7 Claims, 2 Drawing Sheets

POROUS METALS FROM SINTERING OF NANOPARTICLES

CROSS-REFERENCE TO RELATED APPLICATIONS

The application claims the benefit of the earlier filing date of co-pending U.S. Provisional Patent Application No. 61/673,385, filed Jul. 19, 2012 and incorporated herein by reference.

STATEMENT OF GOVERNMENT RIGHTS

This invention was developed under Contract DE-AC04-94AL85000 between Sandia Corporation and the U.S. Department of Energy. The U.S. Government has certain rights in this invention.

FIELD

Porous metals.

BACKGROUND

Nanoporous metals represent a class of functional materials with applications in catalysis, electrocatalysis, fuel cell technologies, biosensing and material storage, to name a few. Nanoporous palladium, for example, has been shown to have applications in catalysis, electrocatalysis and hydrogen isotope storage and separation. The high surface area to metal volume ratios exhibited by nanoporous palladium, for example, may mitigate the formation of destructive, high-pressure helium bubbles from the decay of tritium stored in palladium lattices.

Common methods for synthesis of porous noble metals include chemical or electrochemical reduction of metal salts in hard or soft polymer templates, dealloying, and aggregation or fusion of precursor nanoparticles. Application of these methods to alloy products can be challenging due to differing nucleation and growth rates of each metal that can result in materials with heterogenous metal distributions that vary widely from the nominal mole fractions of metal precursor used in the methods.

One concern with nanoporous metals is the possibility of pore collapse in applications involving exposing the nanoporous metal to increased temperature. Combining palladium with small amounts of a second, higher melting point metal such as platinum or rhodium to form an alloy has been shown to increase the thermal stability of pores, but pore collapse still occurs in regions of virtually pure palladium.

SUMMARY

In one embodiment, a method of forming a nanoporous metal is disclosed. The method includes introducing a metal salt or a combination of metal salts to a solution or fluid including a dendrimer or a polymer with binding sites for metals or metal ions and reducing the ionic metal or metals to a zero valent metal or metals to form a dendrimer encapsulated nanoparticles. The solution is then modified, such as by modifying pH, to disrupt the interaction of the dendrimer or polymer with the zero valent metal or metals. During or following the modification, the metal or metals are partially consolidated or sintered to form a coherent nanoparticle mass. A pH modification of dendrimer or polymer encapsulated or capped nanoparticles such as described provides a mild means of sintering, yielding a mesoporous network of fused nanoparticles. According to this method, in one embodiment, it is possible to synthesize large quantities of compositionally uniform metal alloys, the porous structure of which shows high thermal stability throughout.

In another embodiment, a method is disclosed that includes sequentially reducing two ionic metals to yield core-shell nanoparticle precursors and, following sintering, a porous product with a first metal in the bulk and a second metal representatively enriched at pore surfaces and grain boundaries.

BRIEF DESCRIPTION OF THE DRAWINGS

The invention may best be understood by referring to the following description and accompanying drawings that are used to illustrate embodiments of the invention. In the drawings.

DETAILED DESCRIPTION

Figure 1:
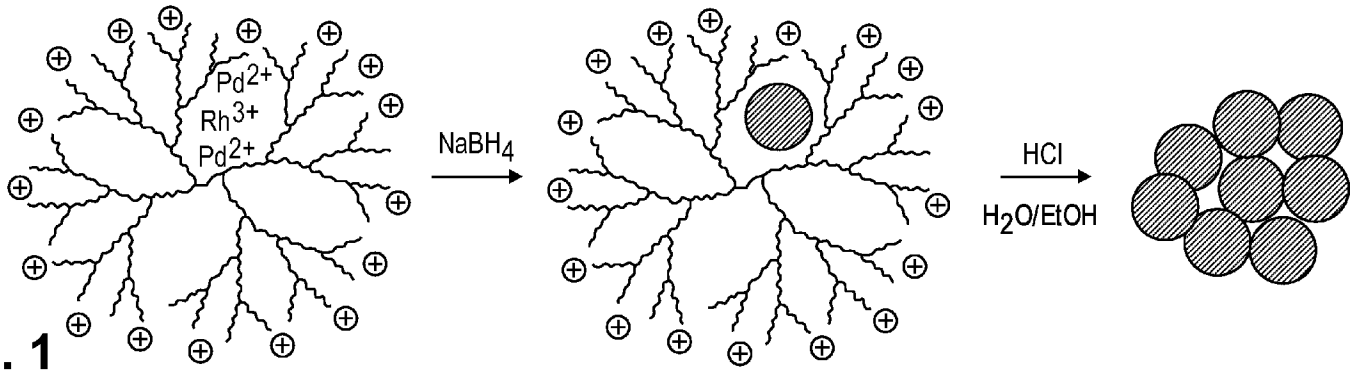
FIG. 1 is a schematic illustration of an embodiment of a process of forming a nanoporous palladium-rhodium alloy.

A method of forming nanoparticles is described. The method is illustrated in FIG. 1. In one embodiment, a method includes introducing a metal salt to a solution comprising a dendrimer or a polymer with binding sites for metals or metal ions. The metal salt is selected according to the nanoparticle product that is desired. Representatively, such product may include palladium, rhodium, platinum, nickel or gold nanoparticles. In another embodiment, where an alloy nanoparticle product is desired, two or more metal salts are selected to be combined in a solution or fluid comprising a dendrimer or polymer. For example, it has been found that rhodium or platinum when combined with palladium in a nanoporous alloy, increases a thermal stability of the nanoporous particle. In such case, a first metal salt including ionic palladium and a second metal salt including ionic rhodium or platinum is added at a desired mole fraction for a final alloy to a solution containing a dendrimer or polymer.

A dendrimer or dendritic polymer is a repetitively branched molecule that is suitable as an encapsulating or capping material for metal or metal ions. In one embodiment, a suitable dendrimer is a commercially available dendrimer such as poly(amido amine) (PAMAM) dendrimer commercially available from Dendritech, Inc. of Midland, Mich. A representative example of an amine surface functional PAMAM dendrimer is a third generation PAMAM dendrimer. Other examples include DAM-AM dendrimers commercially available from Sigma-Aldrich Co., LLC of St. Louis, Mo. Polymers having binding sites for metals or metal ions including polyamides or branched poly(ethyleneimine), also commercially available from Sigma-Aldrich Co, LLC.

The introduction of a metal salt or salts to a solution containing a dendrimer or other polymer allows the metal salt or salts to become encapsulated in the dendrimer or polymer. Representatively, in one embodiment, a PAMAM dendrimer includes tertiary amines that coordinate to the metal ions of the metal salt or salts. A reducing agent such as sodium borohydride ($NaBH_4$) or hydrogen is then introduced to reduce the metal from an ionic state to a zero valent state, leaving dendrimer-encapsulated metal nanoparticles (DEN).

To release the metal nanoparticles from the dendrimer or other polymer or otherwise disrupt or displace the interaction of the metal nanoparticles, the dendrimer or other polymer, a modifying agent is added to the solution. In one embodiment, a modifying agent is selected that has a property to disrupt or reduce an interaction between the dendrimer or other polymer and the nanoparticles. For a dendrimer or other polymer that includes tertiary amines, an acceptable modifying agent is an agent capable of protonating the tertiary amines. Representatively, a modifying agent is an agent that reduces the pH of the solution rendering available hydrogen ions to protonate the tertiary amines of the dendrimer or other polymer. A representative modifying agent that has a property to reduce the pH of the solution is an acid such as hydrochloric acid.

Modifying the solution by adding a modifying agent at least partially separates the nanoparticles from the dendrimer or other polymer, exposing a metal surface. Sintering (coalescing) or partial consolidating occurs with the modification of the solution (e.g., the separated nanoparticles are then sintered when metal surfaces make contact). In one embodiment, a modification and simultaneous sintering is carried out by introducing a modification agent (e.g., a pH lowering agent) in an inert atmosphere (e.g., in a nitrogen atmosphere) to inhibit oxidation of the nanoparticle. In another embodiment, to further inhibit oxidation a reducing agent such as hydrogen (e.g., a one percent hydrogen) may be combined with the nitrogen atmosphere to create a reducing atmosphere. In one embodiment, a sintering process also includes subsequent centrifuging the nanoparticles (e.g., for a palladium-rhodium alloy centrifuge for 10 hours at 8000 revolutions per minute). The nanoparticles are then washed with solvent to provide a finished product.

Figure 2:
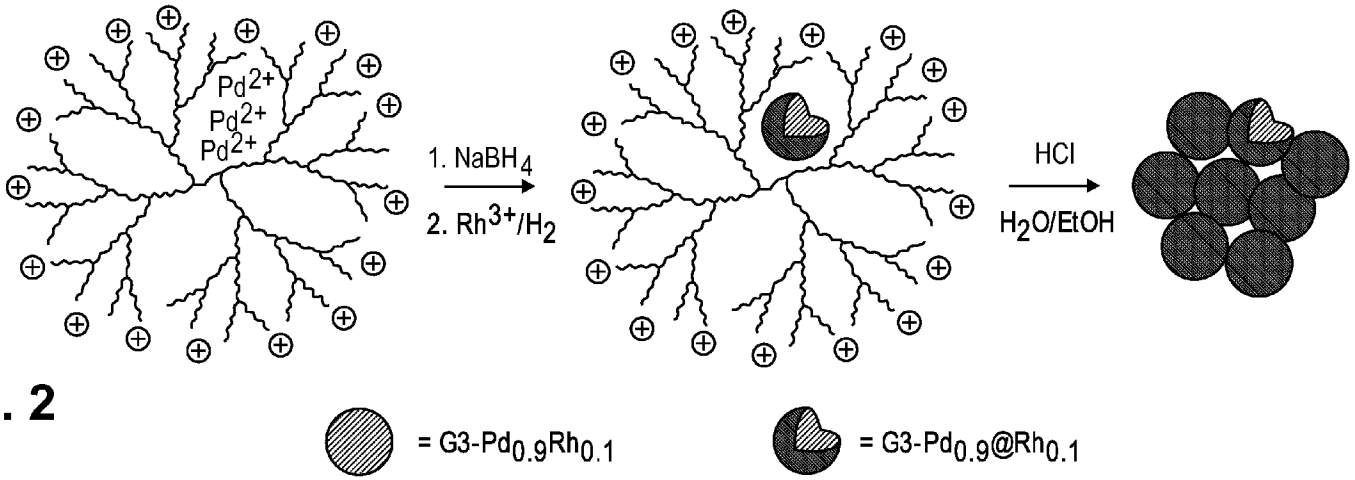
FIG. 2 is a schematic illustration of a second embodiment of a process of forming a nanoporous palladium-rhodium alloy where the alloy has a core-shell configuration.

In another embodiment, a method of forming nanoparticles having a core-shell configuration with one metal enriched at the surface and another metal in the bulk is described. The method is illustrated in FIG. 2. One technique for forming such nanoparticles using the dendrimer or other polymer encapsulation method described above, is by sequentially coordinating different metals to the dendrimer or other polymer (e.g., sequentially adding and reducing two different metal salts to a solution containing a dendrimer). For example, where a first metal of a core-shell configuration is palladium and the palladium is to be the core of the nanoparticle structure, a palladium metal salt may initially be introduced to a solution containing a dendrimer or other polymer (e.g., a generation three PAMAM dendrimer). The palladium salt is then reduced to a zero valent palladium with a first reducing agent (e.g., $NaBH_4$). This is followed by the introduction of a second salt, such as a rhodium salt, intended to be the shell of the nanoparticle structure. The rhodium salt is then reduced to a zero valent rhodium by a second reducing agent that, in one embodiment, is different from the first reducing agent used to reduce the palladium. In one embodiment, a second reducing agent is hydrogen ($H_2$). The reduction of the metal ion of the second salt results in a dendrimer or other polymer encapsulated core-shell nanoparticle. The process operations of releasing the core shell nanoparticles from the dendrimer or other polymer and sintering may then be followed as described above.

EXAMPLE

The metals salts used in the synthesis of $Pd_{0.9}Rh_{0.1}$ (alloy) and $Pd_{0.9}@Rh_{0.1}$ (Pd core, Rh shell) were $K_2PdCl_4$ (anhydrous) and $RhCl_3$ (anhydrous), obtained from Strem Chemicals and Alfa Aesar, respectively. Technical grade, amine-terminated, third generation PAMAM dendrimer was obtained from Dendritech, Inc., $NaBH_4$ was acquired from Fisher Scientific and 4% $H_2$ in $N_2$ was obtained from Matheson Tri-Gas. Reagent alcohol and concentrated HCl used in the dendrimer removal procedure were acquired from VWR and Sigma Aldrich, respectively.

Nanoparticle (NP) and Nanoporous Metal Synthesis

DEN were synthesized using literature procedures, modified to achieve the higher product concentrations necessary for efficient scale up. G3-$Pd_{0.9}Rh_{0.1}$ precursor NP (alloy) were prepared by slow addition of 50.0 mL of an aqueous metal salt stock solution containing 61.3 mM $K_2PdCl_4$ and 6.78 mM $RhCl_3$ (9.96 atom % Rh) to 60.0 mL of 2.62 mM G3-PAMAM dendrimer stock solution that had been adjusted to pH 3 with 2M HCl (21.6:1 metal:dendrimer). The resulting orange-red solution was stirred overnight at room temperature. Subsequently, under a stream of $N_2$ gas and with stirring, 10.0 mL of 2.64 M $NaBH_4$ was added, drop-wise, in three equal-volume aliquots with addition of 1, 2 and 2 mL of 2M HCl after each, respectively. In this manner, DEN or NP aggregation was avoided, while reaching a final pH of 7-8. The resulting stable, colloidal suspension with no apparent aggregation was stirred for four hours before proceeding to the aggregation step detailed below.

G3-$Pd_{0.9}@Rh_{0.1}$ precursor NP (core/shell) were synthesized by the step-wise reduction of dendrimer-encapsulated $K_2PdCl_4$ by $NaBH_4$ followed by encapsulation of $RhCl_3$ in the same dendrimers as the Pd particles, and deposition of the Rh onto the Pd by reduction in 4% $H_2$ in $N_2$To prepare the Pd particles, slow addition of 50.0 mL of 61.3 mM aqueous $K_2PdCl_4$ to 60 mL of 2.62 mM G3-PAMAM dendrimer was followed by reduction with 10.0 mL of 2.64 M $NaBH_4$ similarly to the uniform alloy preparation described above. This solution was stirred for 2 hours after adjusting to pH 7-8. Core/shell NP were prepared by lowering the pH to 3.5 with 2M HCl, followed by addition of 3.00 mL of 113 mM ($3.39\times10^{-4}$ mol) $RhCl_3$. This solution was stirred under $N_2$ gas for 5 hours, after which a humidified stream of 4% $H_2$ in $N_2$ was flowed over the sample, with stirring, for 90 hours in a 250 mL round bottom flask (total volume ~125 mL).

The removal of dendrimer and any unreacted metal salts, and simultaneous sintering of the NP, was carried out by adding 30 mL of 1.3M HCl mixed with 30 mL reagent alcohol to the $Pd_{0.9}Rh_{0.1}$ or $Pd_{0.9}@Rh_{0.1}$ reaction flask and stirring overnight under $N_2$. Subsequently the suspension was centrifuged for 10 hours at 8000 RPM. The resulting pellet was resuspended in ~50 mL of the HCl/alcohol mixture with agitation and sonication and centrifuged for 1 hour. This process was repeated with ~50 mL of acetone and two additional cycles of the HCl/alcohol mixture, followed by two cycles of pure ethanol. Exposure to air was minimized by filling the headspace of the sample with $N_2$ gas in all steps subsequent to $NaBH_4$ reduction of the DEN and throughout the solvent wash/centrifuge steps, due to reports that $Pd^0$ DEN are susceptible to oxidation and dissolution in acidic media.

Characterization of Products

Brunauer-Emmett-Teller surface area, Barrett-Joyner-Halenda pore size distribution and hydrogen storage properties were determined using a Micromeritics ASAP 2020 porosimeter. Nitrogen gas at 77 K was used as the adsorptive for surface area and pore size measurements, and samples were degassed for 15 hours at 50° C. before analysis. Prior to hydrogen absorption experiments, any Pd oxide present on sample surfaces was removed by exposure to 8 Torr of hydrogen gas at room temperature, followed by evacuation. This process was repeated three times and the absence of surface PdO under these conditions was verified by X-ray photoelectron spectrometry (Figure S1). Kinetics of hydrogen uptake were measured by loading the porosimeter manifold to 915 Torr with $H_2$ gas, opening the valve to the sample holder and recording the pressure drop at 25° C. Volumes of the manifold and (manifold+sample holder) were measured with $N_2$ gas before each run. Free expansion of both $N_2$ and $H_2$ gas was complete within 0.5 seconds, as evidenced by control experiments with an empty tube. The remainder of the decrease in pressure was converted to moles H and attributed to absorption by the metal. In the case of $Pd_{0.9}Rh_{0.1}$, a considerable amount of hydrogen was absorbed by the metal during the free expansion. Thermal stability experiments were carried out by ramping to a desired temperature, holding for a specified time, and cooling to room temperature under vacuum before determining surface area as described above. Bulk $Pd_{0.9}Rh_{0.1}$ alloy used for comparison of $H_2$ storage properties with nanoporous materials was prepared by spray atomization of Pd/Rh melts using literature procedures.

Figure 3:
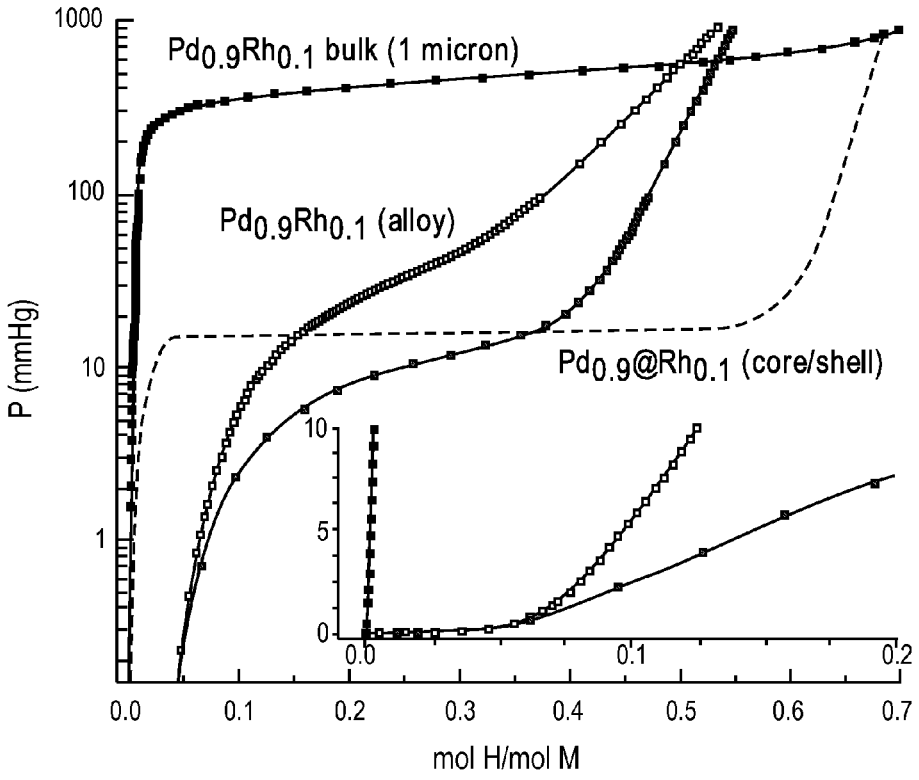
FIG. 3 shows hydrogen storage isotherms of $Pd_{0.9}Rh_{0.1}$ alloy and core-shell and bulk $Pd_{0.9}Rh_{0.1}$.

To evaluate the $Pd_{0.9}Rh_{0.1}$ nanoporous alloy and core-shell materials as candidates for hydrogen storage, their $H_2$ absorption isotherms were measured at room temperature as pressure-composition-temperature (PCT) curves. The absorption branch of the PCT curves of the alloy and core/shell materials are shown in FIG. 3 along with those of bulk $Pd_{0.1}Rh_{0.1}$ and the well-known isotherm exhibited by pure Pd (dotted line). The bulk $Pd_{0.9}Rh_{0.1}$ powder was analyzed to provide a direct comparison with the nanoporous materials, and displays hydrogen absorption behavior in accord with literature reports, with a fairly flat region of the PCT curve at which hydrogen absorption occurs (plateau pressure, $P_{plat}$), between 18 300 and ~700 mmHg. Both the alloy and core/shell materials show hydrogen absorption behavior that is quite distinct from bulk $Pd_{0.9}Rh_{0.1}$ powder.

Previous work has shown that while pore collapse occurs at approximately 150° C. in nanoporous Pd, much greater thermal stability is imparted by alloying with higher melting metals such as Rh. Uneven distribution of Rh in the bimetallic particles during synthesis leads to regions of high Rh concentration displaying elevated thermal stability, and regions of relatively pure Pd in which pores coarsen and collapse at lower temperature. Surface area measurements during the course of aging of nanoporous 20:1 Pd/Rh particles prepared by prior art methods showed a loss of >60% of total surface area over the course of 10 hours. In contrast, very little difference in porosity is observed in room temperature and 300° C. TEM images of $Pd_{0.1}Rh_{0.1}$ and $Pd_{0.9}@Rh_{0.1}$, suggesting that the more uniform Rh distribution achieved here has solved the problem of stability variations within nanoporous bimetallic material. Surface area measurements upon heat-treatment of $Pd_{0.9}Rh_{0.1}$ and $Pd_{0.9}@Rh_{0.1}$ show much more modest surface area losses of 19 and 7%, respectively, after heating for 10 hours at 150° C. Even after sustained temperatures of greater than 300° C., $Pd_{0.9}@Rh_{0.1}$ maintains a surface area of 46 $m^2/g$, suggesting that enrichment of Rh at the particle surfaces confers greater thermal stability compared to the uniform alloy, which exhibits more significant losses in surface area at these temperatures.

In the description above, for the purposes of explanation, numerous specific details have been set forth in order to provide a thorough understanding of the embodiments. It will be apparent however, to one skilled in the art, that one or more other embodiments may be practiced without some of these specific details. The particular embodiments described are not provided to limit the invention but to illustrate it. The scope of the invention is not to be determined by the specific examples provided above but only by the claims below. In other instances, well-known structures, devices, and operations have been shown in block diagram form or without detail in order to avoid obscuring the understanding of the description. Where considered appropriate, reference numerals or terminal portions of reference numerals have been repeated in the figure to indicate corresponding or analogous elements, which may optionally have similar characteristics.

It should also be appreciated that reference throughout this specification to "one embodiment", "an embodiment", "one or more embodiments", or "different embodiments", for example, means that a particular feature may be included in the practice of the invention.

Similarly, it should be appreciated that in the description, various features are sometimes grouped together in a single embodiment, figure, or description thereof for the purpose of streamlining the disclosure and aiding in the understanding of various inventive aspects. This method of disclosure, however, is not to be interpreted as reflecting an intention that the invention requires more features than are expressly recited in each claim. Rather, as the following claims reflect, inventive aspects may lie in less than all features of a single disclosed embodiment. Thus, the claims following the Detailed Description are hereby expressly incorporated into this Detailed Description, with each claim standing on its own as a separate embodiment of the invention.

The invention claimed is:

1. A method comprising:

introducing a metal salt to a solution comprising a dendrimer with binding sites for metals or metal ions;

reducing the metal salt to zero valent metal to form dendrimer encapsulated metallic nanoparticles;

modifying the solution with a modification agent to disrupt an interaction of the dendrimer with the metallic nanoparticles; and subsequently or concomitantly with modifying the solution, sintering or partially consolidating a metallic nanoparticle mass.

2. The method of claim 1, wherein modifying the solution comprises lowering the pH.

3. The method of claim 1, wherein introducing a metal salt comprises introducing a first metal salt and a different second metal salt.

4. The method of claim 3, wherein the first metal salt comprises palladium and the second metal salt comprises rhodium.

5. The method of claim 1, wherein introducing a metal salt comprises introducing a first metal salt and a different second metal salt, and the atomic fraction of the second metal salt is enriched at or near the surface of the nanoparticle mass.

6. The method of claim 5, wherein the first metal salt comprises palladium and the second metal salt comprises rhodium.

7. The method of claim 1, wherein the modifying is done under a reducing atmosphere.

* * * * *